US007172306B1

(12) United States Patent
Campa

(10) Patent No.: US 7,172,306 B1
(45) Date of Patent: Feb. 6, 2007

(54) LIGHTED DEADBOLT

(76) Inventor: Ricky Campa, 21611 Milsa, San Antonio, TX (US) 78256

( * ) Notice: Subject to any disclaimer, the term of this patent is extended or adjusted under 35 U.S.C. 154(b) by 72 days.

(21) Appl. No.: 11/097,704

(22) Filed: Apr. 1, 2005

Related U.S. Application Data

(60) Provisional application No. 60/558,805, filed on Apr. 2, 2004.

(51) Int. Cl.
*E05B 17/10* (2006.01)

(52) U.S. Cl. ..... 362/100; 362/94; 362/137

(58) Field of Classification Search ..... 362/100, 362/94
See application file for complete search history.

(56) References Cited

U.S. PATENT DOCUMENTS 4,683,741 A * 8/1987 Fields ..... 70/432
4,760,380 A * 7/1988 Quenneville et al. ..... 340/542
5,179,325 A * 1/1993 Aragon, Jr. ..... 315/136
5,461,360 A * 10/1995 Guim et al. ..... 340/457
5,680,094 A * 10/1997 Guim et al. ..... 340/332
5,712,615 A * 1/1998 Maffey et al. ..... 340/332
5,783,995 A * 7/1998 Jackson ..... 340/545.7
6,278,366 B1 * 8/2001 Fletcher et al. ..... 340/542
6,461,013 B1 * 10/2002 Simon ..... 362/100

* cited by examiner

*Primary Examiner*—Ali Alavi
*Assistant Examiner*—Hargobind S. Sawhney
(74) *Attorney, Agent, or Firm*—Kenneth L Tolar

(57) ABSTRACT

A deadbolt having an integral light that is activated only when the deadbolt is properly locked includes a conventional deadbolt housing attached to a door. The housing includes a latch section that is mounted on an inner surface of a door having a drive member thereon. The drive member operates a latch shaft that extends and retracts a striker to lock and unlock the door. An LED is positioned on the latch section that is activated with an internally disposed magnetic reed switch. When the shaft is rotated to a locked position, a magnet positioned thereon substantially aligns with the magnetic reed switch to activate the LED. When the deadbolt is unlocked, the magnet is rotated out of alignment with the reed switch thereby deactivating the LED.

4 Claims, 1 Drawing Sheet

LIGHTED DEADBOLT

CROSS REFERENCE TO RELATED APPLICATIONS

This application is entitled to the benefit of provisional application No. 60/558,805 filed on Apr. 2, 2004.

BACKGROUND OF THE INVENTION

The present invention relates to a deadbolt having an integral light that is only activated when the bolt is locked to visually alert a nearby user of the lock status.

DESCRIPTION OF THE PRIOR ART

Deadbolts are used in many buildings to further secure outside doors. However, verifying that the deadbolt is properly locked is never easy, particularly in larger dwellings or those with multiple floors. Typically, a user must traverse the interior or a stairway and closely scrutinize the deadbolt to ascertain the status thereof. The present invention addresses this problem by providing a deadbolt with an integral light that is only activated when the deadbolt is properly locked. Accordingly, a user can readily determine the status of the lock at a significant distance therefrom.

SUMMARY OF THE INVENTION

The present invention relates to a lighted deadbolt. The device comprises a deadbolt housing including a key receptacle section positioned on the exterior surface of the door and a latch section with a rotatable latch for positioning on the interior surface of the door. Both the latch and the key receptacle operate an internal shaft that in turn extends and retracts a striker between a locked an unlocked position. Received within the housing is a substantially circular circuit board having a centrally disposed aperture that receives the shaft. The circuit board includes a capacitor, an LED, a flasher oscillator and a battery terminal to which internal batteries are connected. The circuit is activated with a magnetic reed switch disposed on the circuit board. A magnet is positioned on the shaft such that when the shaft is rotated to move the striker to a locked position, the magnet is substantially aligned with the magnetic reed switch thereby activating the LED. When the shaft is rotated to move the striker to an unlocked position, the magnet and reed switch are misaligned thereby disabling the LED.

It is therefore an object of the present invention to provide a deadbolt that conspicuously alerts the user of the status thereof.

It is another object of the present invention to provide a deadbolt having a light indicator means thereon allowing a user to remotely determine if the deadbolt is locked.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
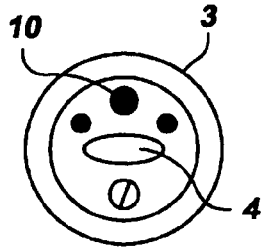
FIG. 1 is a front view of the housing latch section.
Figure 2:
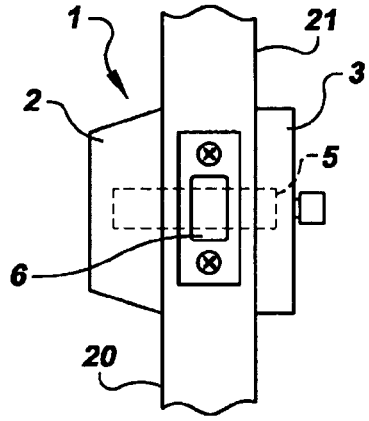
FIG. 2 is a side view of the housing sections properly mounted on a door.
Figure 3:
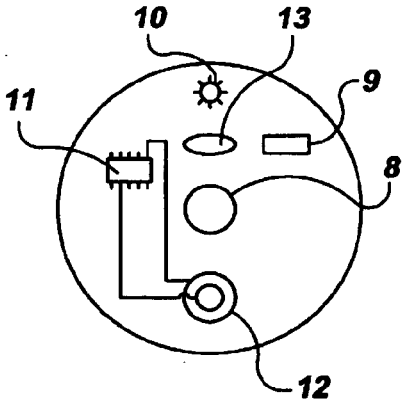
FIG. 3 is a top, plan view of the circuit board.
Figure 4:
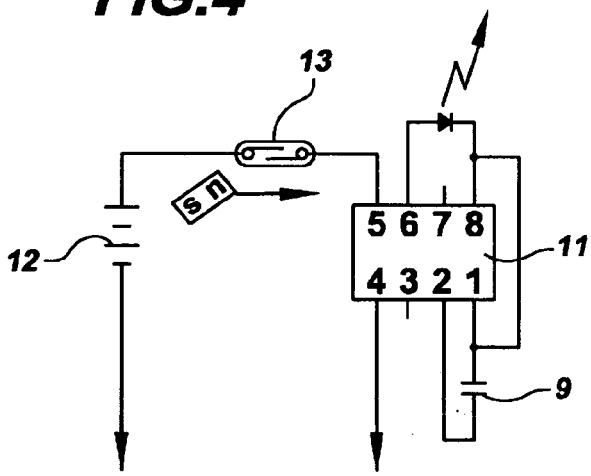
FIG. 4 is a schematic of the various electronic components according to the present invention.
Figure 5:
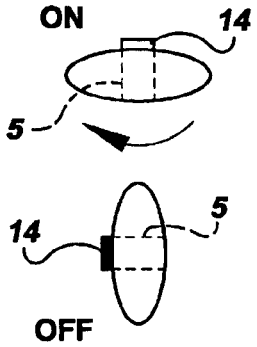
FIG. 5 depicts the relative positioning of the shaft and attached magnet in the locked and unlocked positions.

The present invention relates to a lighted deadbolt. The device comprises a deadbolt housing 1 including a key receptacle section 2 positioned on the exterior surface 20 of the door and a latch section 3 with a rotatable drive member such as a latch 4 thereon that is mounted on the interior surface 21 of the door. Both the latch and the key receptacle operate an internal shaft 5 that in turn extends and retracts a striker 6 between a locked and an unlocked position.

Within the housing interior is a substantially circular circuit board 7 having a centrally disposed aperture 8 that receives the shaft. The circuit board includes a light producing circuit including a capacitor 9, an LED 10, a flasher oscillator 11 and a battery terminal 12 to which internal batteries are connected. The circuit is activated with a magnetic reed switch 13 positioned on the circuit board. A magnet 14 is positioned on the shaft such that when the shaft is rotated to move the striker to a locked position, the magnet is substantially aligned with the magnetic reed switch thereby activating the LED. When the shaft is rotated to move the striker to an unlocked position, the magnet and reed switch are misaligned thereby disabling the LED. The oscillator pulses the LED illumination to extend the battery life considerably; for example, when active, the LED will illuminate for several hundred milliseconds every two seconds though the time intervals can be varied as desired.

The above described device is not limited to the exact details of construction and enumeration of parts provided herein. For example, though a latch section is shown and described for placement on the interior surface of the door, a second key section could instead be used. Additionally, though the device is depicted and described as a lighted deadbolt, the light producing circuitry can be incorporated into a door knob having a rotating locking means or any other rotating locking device without departing from the spirit of the present invention. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A lighted locking device comprising:

a housing including a key receptacle section positioned on an exterior surface of a door and an inner section positioned on an interior surface of a door;

a locking latch means for locking engagement with a door jamb, said latch means moveable between a locked position and an unlocked position;

a light means on said inner section that is activated when said latch means is moved into the locked position for visually indicating to persons nearby that a door is securely locked.

2. The lighted deadbolt according to claim 1 wherein said light means includes:

a light positioned on said inner section;

a magnetic reed switch for activating said light, said switch positioned within said housing and connected to said light and a power source;

a magnet carried by said latch means that when said latch means is moved to the locked position, the magnet is substantially aligned with the magnetic reed switch thereby activating the light.

3. The lighted deadbolt according to claim 1 further comprising an oscillator electrically connected to said light and said magnetic reed switch for pulsing said light.

4. A lighted lock comprising:

a housing including a key receptacle section positioned on an exterior surface of a door and a latch section with a rotatable drive member for positioning on an interior surface of a door;

an internal shaft received within said housing and operably connected to said key receptacle and said drive member;

a striker movable between a locked, extended position and an unlocked retracted position by rotation of said shaft;

a light positioned on the latch section of the housing;

a magnetic reed switch positioned adjacent said shaft and electrically connected to a power source and said light;

a magnet positioned on the shaft such that when the shaft is rotated to a position where the striker is in the locked, extended position, the magnet is substantially aligned with the magnetic reed switch thereby activating the light, and when the shaft is rotated to a position where the striker is in an unlocked, retracted position, the magnet and reed switch are misaligned thereby disabling the light.

* * * * *